US005316438A

United States Patent [19]

Tubbs

[11] Patent Number: 5,316,438

[45] Date of Patent: May 31, 1994

[54] GAS TURBINE ENGINE VARIABLE AEROFOIL VANE ACTUATION MECHANISM

[75] Inventor: Henry Tubbs, Tetbury, Great Britain

[73] Assignee: Industria de Turbo Propulsores S.A., Vizcaya, Spain

[21] Appl. No.: 52,551

[22] Filed: Apr. 23, 1993

[30] Foreign Application Priority Data

Jan. 29, 1993 [ES] Spain ..... P9300166

[51] Int. Cl.[5] ..... F01D 17/16; F01D 21/14

[52] U.S. Cl. ..... 415/118; 415/150; 415/160

[58] Field of Search ..... 415/13, 118, 150, 159, 415/160

[56] References Cited

U.S. PATENT DOCUMENTS 3,613,721 10/1971 Horn ..... 415/13
4,695,220 9/1987 Dawson ..... 415/160
5,024,580 6/1991 Olive ..... 415/150

FOREIGN PATENT DOCUMENTS 2210108 6/1989 United Kingdom ..... 415/160

*Primary Examiner*—Edward K. Look
*Assistant Examiner*—Christopher Verdier
*Attorney, Agent, or Firm*—Brumbaugh, Graves, Donohue & Raymond

[57] ABSTRACT

An aerofoil vane actuation mechanism suitable for a gas turbine engine (10) comprises an annular array of pivotable aerofoil vanes (21) which are linked to an annular actuation member (30) by a plurality of levers (27). Each aerofoil vane (21) additionally has an indication lever (31) attached to it. Each indication lever (31) cooperates with the actuation member (30) so that under normal conditions, during pivoting of the vanes (21), no load transfer takes place between them. However in the event of one or more of the vanes (21) failing to pivot properly, such load transfer does take place. Means (37) are provided to detect such load transfer to provide an indication of such failure of a vane (21) to pivot properly.

7 Claims, 5 Drawing Sheets

GAS TURBINE ENGINE VARIABLE AEROFOIL VANE ACTUATION MECHANISM

BACKGROUND OF THE INVENTION

This invention relates to an aerofoil vane actuation mechanism suitable for a gas turbine engine.

Axial flow compressors and turbines for gas turbine engines comprise axially alternative annular arrays of stator aerofoil vanes and rotary aerofoil blades. In order to improve engine efficiency over a wide range of operating conditions, some of the stator aerofoil vanes may be mounted in such a way that each vane is pivotable, over a limited range, about its longitudinal axis. Typically all of the vanes in at least one annular array are arranged to so pivot.

Pivoting the vanes in this manner permits the flow capacity of the compressor or turbine to be changed, thereby ensuring that the flow capacity is always at an optimum value for the particular operating conditions of the engine.

It is important that all of the vanes in a given annular array pivot simultaneously and to the same degree. One common way of achieving this is to attach each vane in a given annular array to a common actuation ring by means of levers. The actuation ring circumscribes the compressor or turbine casing which contains the vanes. Each vane has a lever attached to it which is also pivotally attached to the actuation ring. Rotation of the ring about the engine axis over a limited circumferential distance provides the desired simultaneous pivoting of the vanes.

Under normal circumstances, such vane actuation mechanisms are highly satisfactory. However if one or more of the vanes in a given array should not pivot due, for instance, to thermal or mechanical deterioration, their actuation levers could be subject to uncontrolled flexure. As well as possibly causing damage to the actuation mechanism, there would also be non-simultaneous actuation of the vanes in the array. Such non simultaneous actuation is highly undesirable since it could result in cyclic fatigue damage of the rotor assembly immediately upstream or downstream of the vanes. This, in turn, could possibly lead to engine failure.

It is our object of the present invention to provide a vane actuation mechanism in which such uncontrolled flexure of the mechanism is substantially avoided.

SUMMARY OF THE INVENTION

According to the present invention, an aerofoil vane actuation mechanism suitable for a gas turbine engine comprises an annular actuation member extending around the circumference of said engine, a plurality of aerofoil vanes pivotable about their longitudinal axes, and a plurality of actuation levers, each actuation lever interconnecting a corresponding one of said aerofoil vanes with said actuation member, to facilitate the simultaneous, equal pivotal movement of said aerofoil vanes about their longitudinal axes by said actuation member, each of said aerofoil vanes additionally having an indication lever attached thereto, to pivot therewith, each said indication lever cooperating with said actuation member in such a manner that during said simultaneous equal pivotal movement of said aerofoil vanes about their longitudinal axes, substantially only relative pivotal movement about a gives axis occurs between each indication lever and said actuation member, means being provided to respond to any non-pivotal relative movement about said given axis between any of said indication levers and said actuation member resulting from the non-simultaneous, non-equal pivotal movement of the aerofoil vane attached to that indication lever, to provide an indication of such non-simultaneous, non-equal pivotal vane movement.

BRIEF DESCRIPTION OF THE DRAWING

The present invention will now be described, by way of example, with reference to the accompanying drawings in which.

DETAILED DESCRIPTION OF THE PREFERRED EMBODIMENTS

Figure 1:
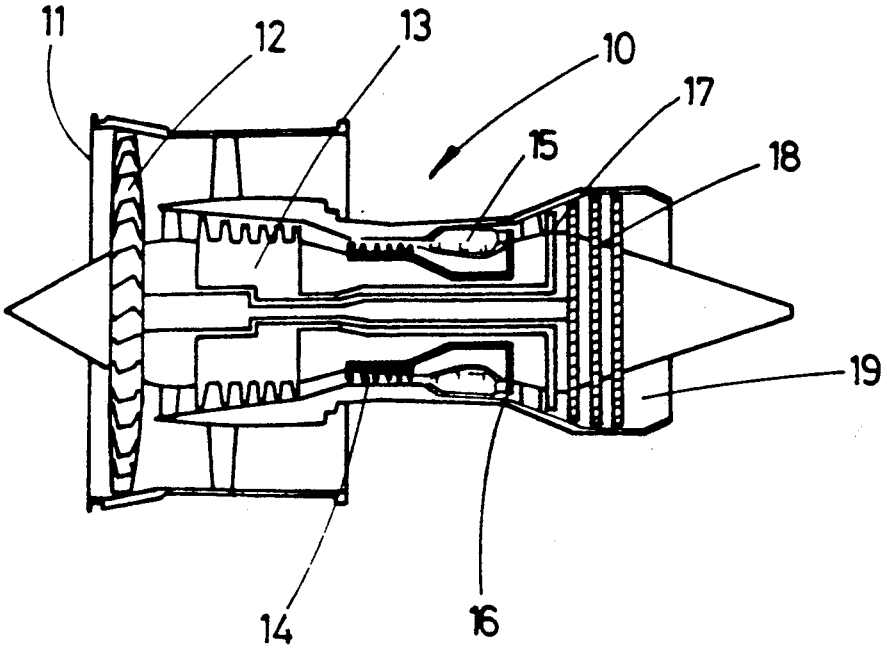
FIG. 1 is a sectioned side view of a ducted fan gas turbine engine which incorporates an aerofoil vane actuation mechanism in accordance with the present invention.

Referring to FIG. 1., a ducted fan gas turbine engine generally indicated at 10 is generally of conventional construction. It comprises, in axial flow series, an air intake 11, ducted fan 12, intermediate and high pressure compressors 13 and 14 respectively, combustion equipment 15, high, intermediate and low pressure turbines 16, 17 and 18 respectively and an exhaust nozzle 19. The engine 10 functions in the conventional manner whereby air entering the inlet 11 is accelerated by the fan 12. The air exhausted from the fan is divided into two flows: one being exhausted to atmosphere to provide propulsive thrust and the other into the intermediate pressure compressor 13. The intermediate pressure compressor 13 compresses the air before directing it into the high pressure compressor 14 where further compression takes place. The thus compressed air is then mixes with fuel and the mixture combusted in the combustion equipment 15. The resultant hot combustion products then expand through, and thereby drive, the high, intermediate and low pressure turbines 16,17 and 18 respectively before being exhausted through the propulsion nozzle 19 to provide additional propulsive thrust.

The high, intermediate and low pressure turbines 16,17 and 18 are respectively interconnected with, and thereby drive, the fan 12, intermediate pressure compressor 13 and high pressure compressor 14.

Figure 2:
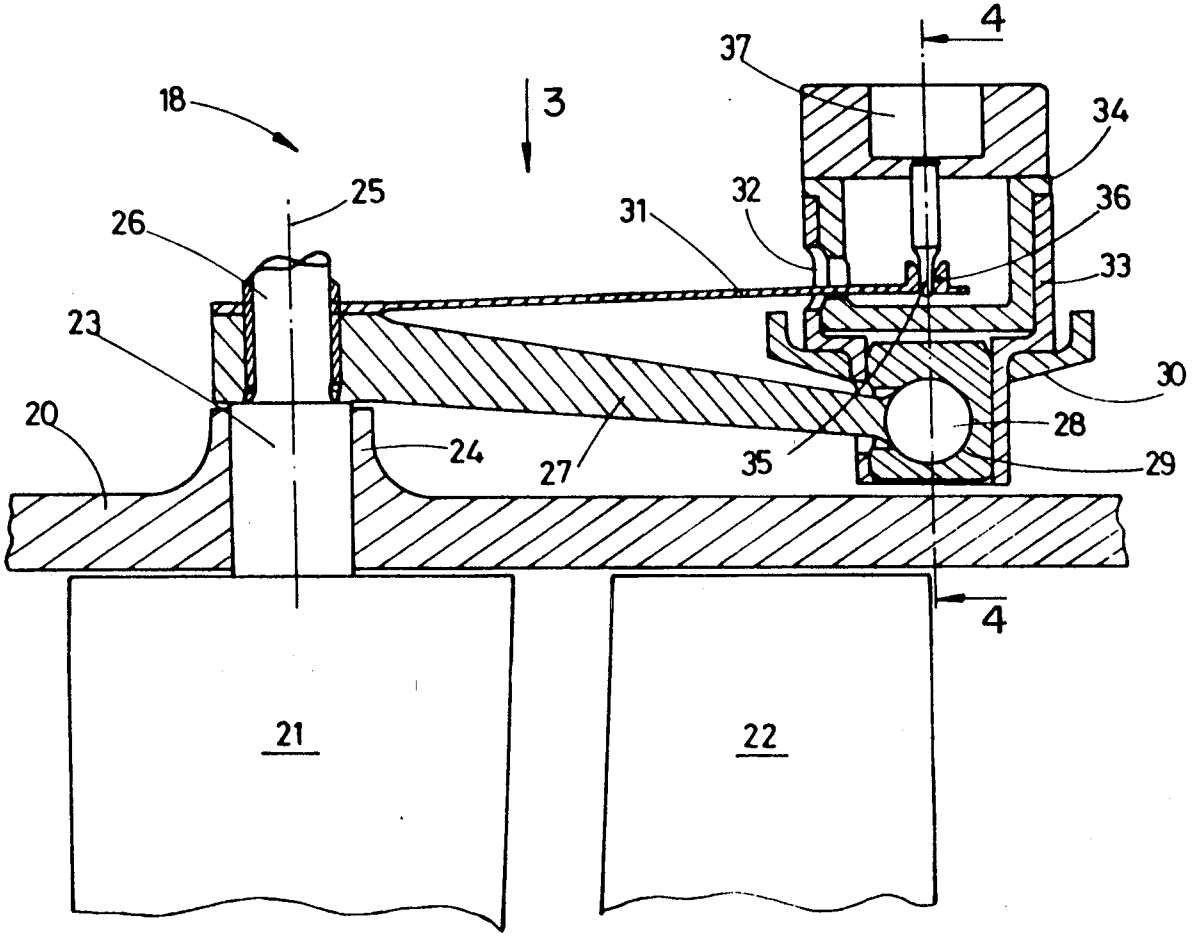
FIG. 2 is a sectioned side view, on an enlarged scale, of a part of the aerofoil vane actuation mechanism of the ducted fan gas turbine engine shown in FIG. 1.

The low pressure turbine 18 comprises axially alternate annular arrays of aerofoil stator vanes and aerofoil rotor blades. Part of the low pressure turbine 18 can be seen more easily if reference is now made to FIG. 2. In FIG. 2 there can be seen part of the casing 20 of the low pressure turbine 18 and the radially outer extents of one of the stator aerofoil vanes 21 and one of the rotor aerofoil blades 22.

The stator aerofoil vane 21 is one of a plurality of similar vanes which are, as previously stated, arranged in an annular array. Each vane 21 is provided at its radially outer extent with a circular cross-section spindle 23 which locates in a correspondingly shaped housing 24 provided in the casing 20. A similar spigot (not shown) is provided at the radially inner extent of the vane 21. Its longitudinal axis is coaxial with the longitudinal axis 25 of the radially outer spindle 23 and it is also located in a correspondingly shaped housing (not shown). The vanes 21 are therefore able to pivot about their axes 25.

Figure 3:
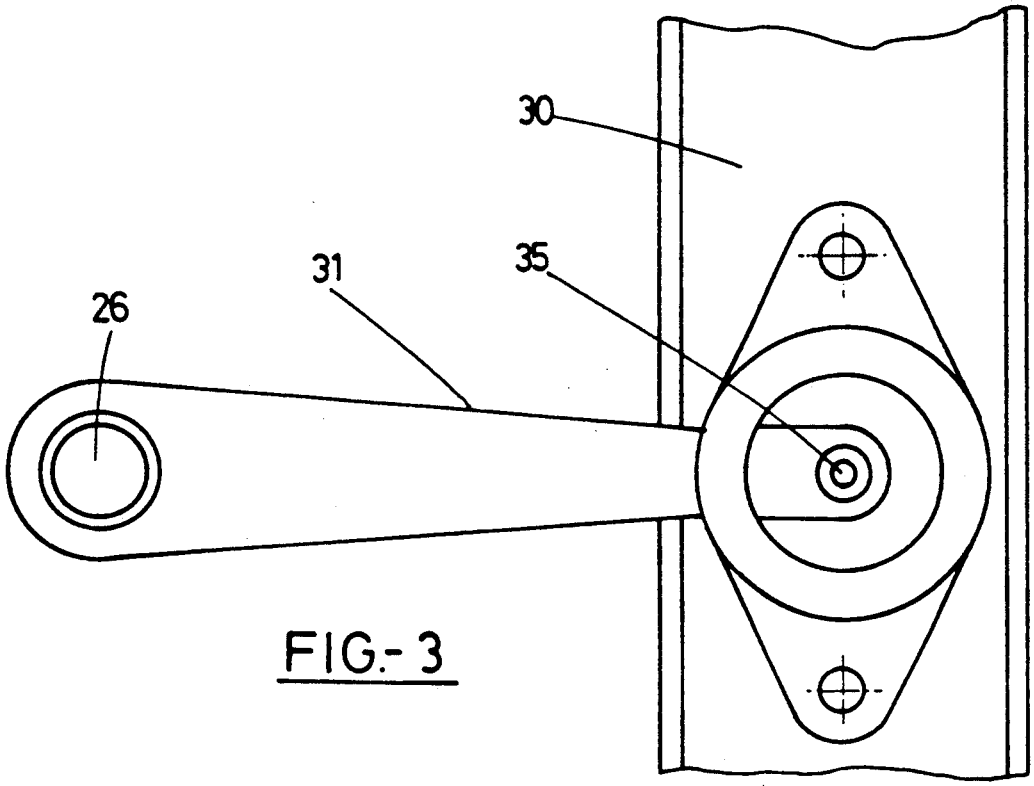
FIG. 3 is a view on arrow 3 of FIG. 2.
Figure 4:
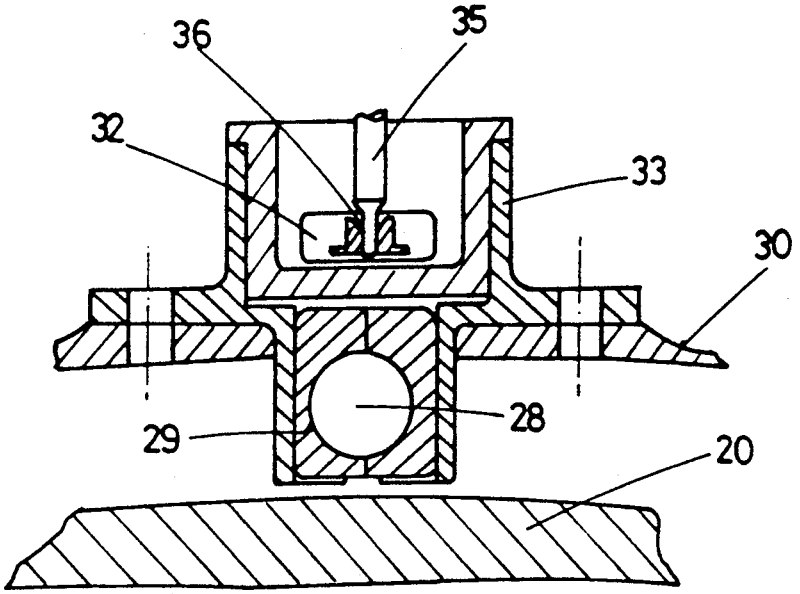
FIG. 4 is a view on section line 4—4 of FIG. 2.

Each spindle 23 is provided with a radially outwardly extending extension 26 to which is attached an actuation lever 27. The actuation lever 27 is provided on the end thereof remote from the extension 26 with a spherical end 28. Each spherical lever end 28 locates in a correspondingly shaped socket 29 which is carried by an actuation ring 30. As can be seen in part in FIG. 3, the actuation ring 30 extends around the circumference of the casing 20 in radially spaced apart relationship therewith. It is caused by means not shown (such as hydraulic rams) to rotate about the casing 20 by a short amount in either a clockwise or anti-clockwise direction. Such rotation causes actuation of the levers 27 and in turn, partial rotation of the vanes 21 about their axes 25. Since all of the vanes 21 are attached to the actuation ring 30 by actuation levers 27, they simultaneously pivot by equal amounts about their pivotal axes 25.

During circumferential movement of the actuation ring 30 with corresponding rotation of each of the aerofoil vanes 21 and actuation levers 27, relative radial movement of the spherical lever ends 28 with regard to the sockets 29 is accommodated by freedom of the sockets 29 to slide radially in the actuation ring 30.

The spindle extension 26 of each vane 21 additionally carries an indication lever 31. Each indication lever 31 extends in the same general direction as the actuation lever 27. It passes through an aperture 32 provided in an extension structure 33 located on the actuation ring 30 radially outwardly of the socket 29. Each extension structure 33 is open at its radially outer extent 34 to receive the arm 35 of a movement detector shown schematically at 37. Each movement detector arm 35 locates in a corresponding aperture 36 provided in the end portion of each indication lever 31.

Each movement detector 37 is of conventional construction. It is adapted to detect load transfer resulting from relative non-pivotal movement between the detector arm 35, and hence the indication lever 31, and the extension structure 33. When such relative non pivotal movement occurs, the movement detector provides an appropriate electrical output signal.

Such relative non-pivotal movement, as indicated by the movement detector 37, occurs if there is circumferential movement of the actuation ring 30 which is not accompanied by corresponding pivotal movement of one or more of the vanes 21. This could happen for instance, as a result of the seizure or partial seizure of one or more of the vane spigots 23 in their housings 24. Under such circumstances there would be some distortion of the appropriate actuation levers 27. However in order to prevent such damage to the actuation mechanism, and indeed other parts of the engine 10, the output signal from the movement detector 37 is used to send a halt command to the operating system of the actuation ring 30. Consequently movement of the actuation ring 30 is stopped before any major engine damage can occur.

In the present case, the movement detectors 37 are electrically operated. It will be appreciated, however, that it is not essential that they should be so operated. For instance, they could be operated optically or hydraulically. Essentially they should be capable of detecting non-pivotal movement between the indication levers 31 and the actuation ring 30.

Figure 5:
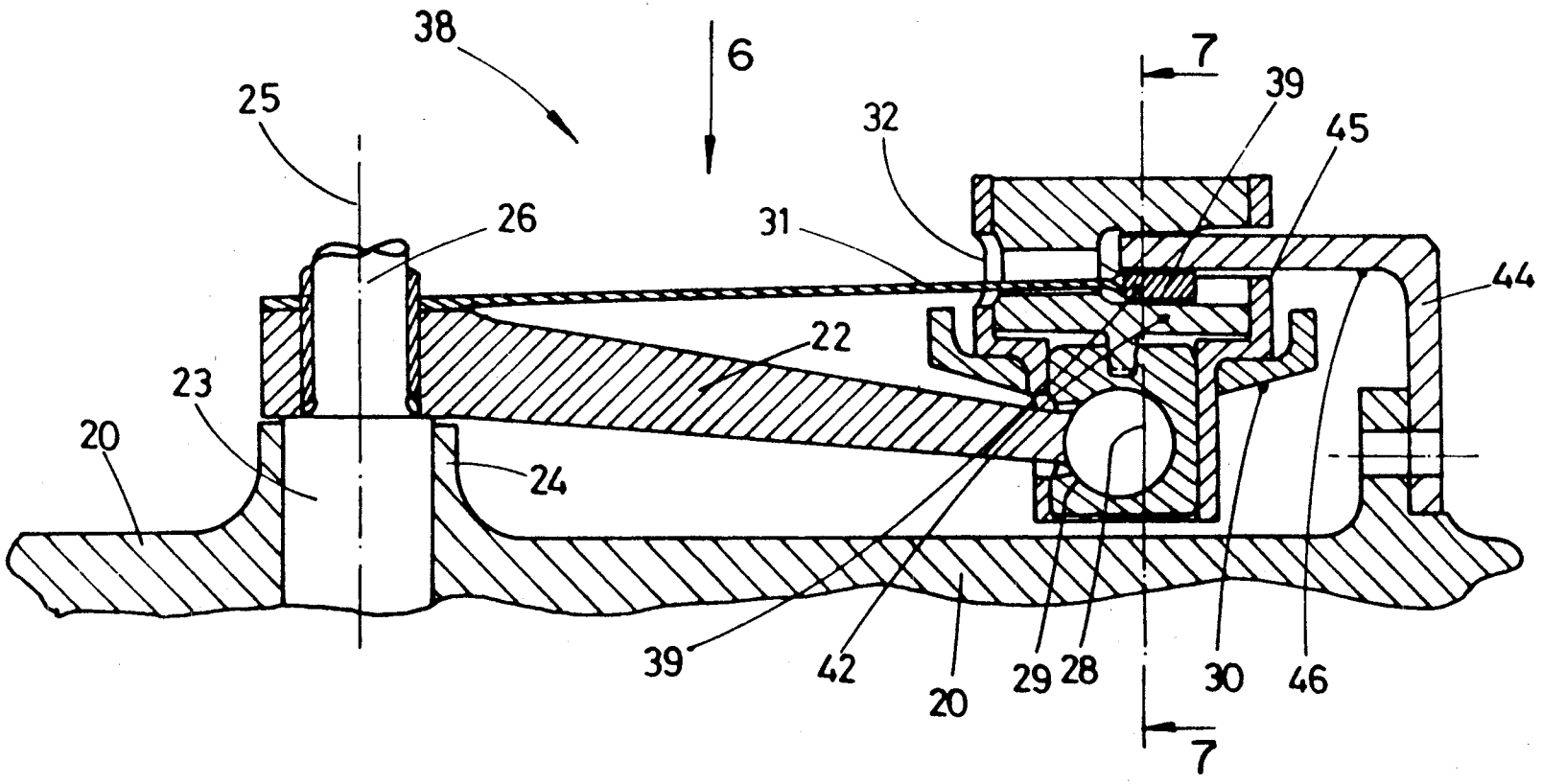
FIG. 5 is a sectioned side view, similar to the view shown in FIG. 2, of an alternative embodiment of the aerofoil vane actuation mechanism in accordance with the present invention.
Figure 6:
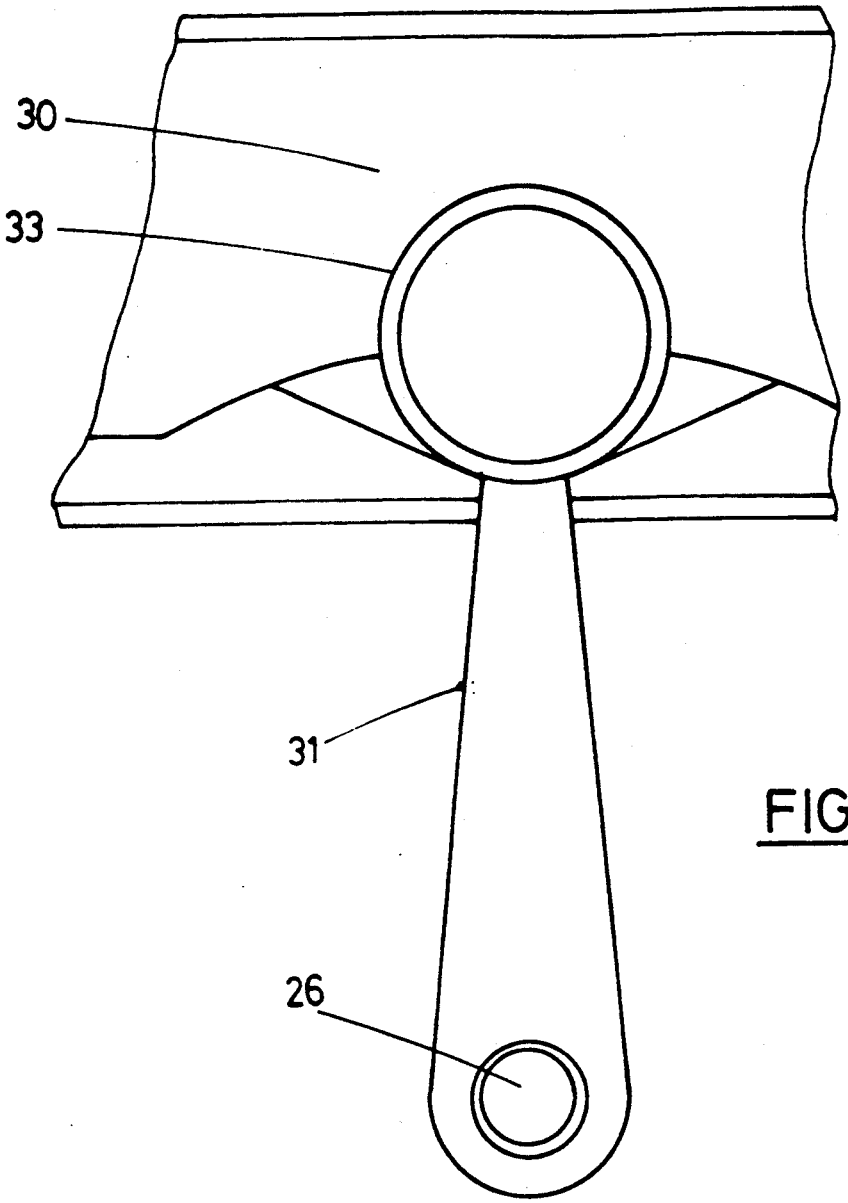
FIG. 6 is a view on arrow 6 of FIG. 5.
Figure 7:
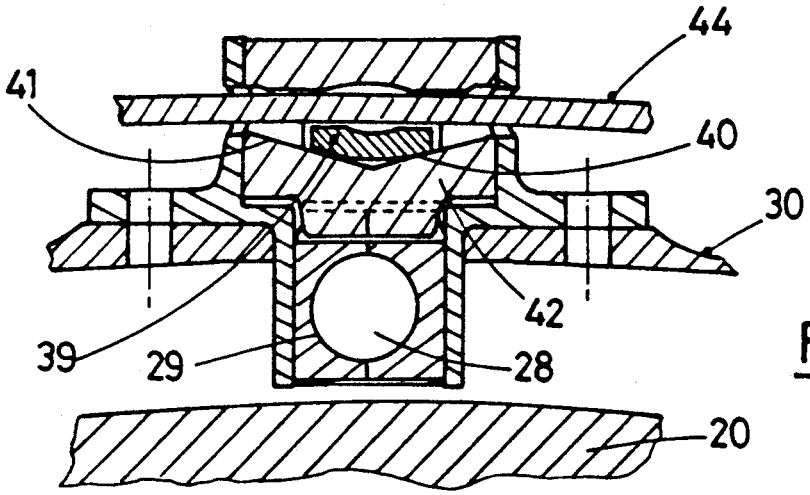
FIG. 7 is a view on section line 7—7 of FIG. 5.

It may be desirable in certain cases to have an actuation mechanism which causes locking of the actuation ring 30 in the event of the seizure or partial seizure of one or more of the vane spindles 23 in their housings 24. Such a mechanism 38 is shown in FIGS. 5 to 7.

A large proportion of the component parts of the actuating mechanism 38 are common with the mechanism of FIG. 2 and therefore share the same reference numerals.

In essence, the actuating mechanism 38 operates in a similar fashion to that shown in FIG. 2. However, the ends 39 of each of the indication levers 31 which are remote from the spindle extension 26 are of generally wedge-shaped configuration. Additionally, their radially inward faces 40 are slightly curved in a convex manner as can be seen in FIG. 7. Each face 40 locates on a surface 41 which is of tapered cross-section. Each surface 41 is defined by a locking housing 42 which is carried by the actuation ring extension structure 33. As in the case of the spherical socket 29 each locking housing 42 is free to move radially in the actuation ring 30 to accommodate any unwanted small radial movements. It is also rotationally linked with the socket 29 through a tongue and groove guide.

The turbine casing 20 carries an L-shape cross section ring 44 which extends through slots 45 provided in each of the extension structures 33. The radially inner surface 46 of the portion of the ring 44 which extends through the extension structure slots 45 is situated adjacent the radially outermost parts of the actuating lever ends 39.

Under normal operating conditions, the indicating lever ends 39 rest immediately adjacent their respective locking housing surfaces 40 and the ring 44 so that substantially no load transfer occurs between the actuation ring 30 and the indication levers 31. However in the event of the seizure or partial seizure of one or more of the vanes 21, relative circumferential movement occurs between the indication lever 31 associated with the affected vane or vanes 21 and the actuation ring 30. This in turn results in the tapered cross-section surface 40 of the locking housing 42 urging the wedge-shaped actuation lever end 39 into engagement with the radially inner surface 46 of the fixed ring 44. This has the effect of locking the relevant actuating lever 31 and the actuation ring 30 to the fixed ring 44 through frictional forces, thereby preventing further movement of the actuation ring 30. Consequently the locking of the actuation ring 30 ensures that engine damage which would otherwise occur is avoided.

It will be seen therefore that the present invention provides an aerofoil vane actuation system in which indication levers 31 are not normally in load transfer relationship with the vane actuation ring 30. However in the event of one or more of the vanes 21 becoming seized or partially seized, non-pivotal relative movement leading to load transfer does take place. That load transfer can be used to produce a signal from a suitable detector which is used to discontinue the application of power to the actuation ring 30. Alternatively the load transfer can be used to lock the actuation ring 30 relative to the turbine casing 20 to prevent further movement.

In both embodiments, the continued actuation of the actuation ring 30, which could result in undesirable engine damage, is avoided.

I claim:

1. In a gas turbine engine, an actuation mechanism for rotating a plurality of aerofoil vanes spaced circumferentially about a center line, each having a spindle extending through a casing about which the vane is pivotable, comprising:

an annular actuation member circumferentially surrounding said engine;

a plurality of actuation levers, each actuation lever interconnecting a corresponding one of said aerofoil vanes with said actuation member for causing simultaneous equal pivotal movement of said aerofoil vanes about their longitudinal axes as said actuation member is rotated;

a like plurality of indication levers each having first and second ends, each said indication lever being attached at a first end to a respective aerofoil vane to pivot therewith and cooperating with said actuation member in such a manner that during said simultaneous equal pivotal movement of said aerofoil vanes about their spindles, substantially only relative pivotal movement occurs between each indication lever and said actuation member; and means supported on said actuating member and cooperating with a second end of each indication lever and responsive to any non-pivotal relative movement about said given axis between any of said indication levers and said actuation member resulting from the non-simultaneous, non-equal pivotal movement of any aerofoil vane attached to any indication lever, to provide an indication of such non-simultaneous, non-equal pivotal vane movement.

2. An aerofoil vane actuation mechanism as claimed in claim 1, wherein said last-mentioned means includes means for producing a signal which is directed to halt rotation of said actuation member.

3. An aerofoil vane actuation mechanism as claimed in claim 2, wherein said means responsive to any non-pivotal relative movement between said indication lever and said actuation member comprises a movement detector for detecting load transfer resulting from relative non-pivotal relative movement between said second end of said indication lever and said actuation member.

4. An aerofoil vane actuation mechanism as claimed in claim 1, wherein said means responsive to said non-pivotal relative movement between said indication lever and said actuation member includes a wedge-shaped extension at said second end of each of said indication levers for frictionally gripping and locking together said actuation member and the casing of said gas turbine engine in response to said non-pivotal relative movement, and preventing further relative movement between said actuation member and said casing.

5. An aerofoil vane actuation mechanism as claimed in claim 1 wherein said aerofoil vanes are arranged in an annular array, said actuation member comprising a ring positioned coaxially with said annular array.

6. In a gas turbine engine having a casing, an actuation mechanism for rotating a plurality of aerofoil vanes arranged in an annular array about a center line and spaced circumferentially, each having a spindle extending through said casing about the longitudinal axis of which the vane is pivotable, comprising:

an annular actuation member positioned coaxially with said array of vanes;

a plurality of actuation levers each interconnecting a respective one of said aerofoil vanes with said actuation member for causing simultaneous equal pivotal movement of said vanes about their longitudinal axes as said actuation member is rotated;

a like plurality of indication levers each having first and second ends, each attached at its first end to a respective aerofoil vane to pivot therewith, each said indication lever cooperating with said actuation member in such a manner that so long as the pivotal movement of said aerofoil vanes about their longitudinal axes is simultaneous and equal substantially only relative pivotal movement occurs between each indication lever and said actuation member; and means responsive to any non-pivotal relative movement between any of said indication levers and said actuation member for providing an indication of any non-simultaneous, non-pivotal aerofoil vane movement, comprising:

a static member adapted for attachment to the casing of said gas turbine engine and defining an engagement surface, means defining an engagement surface on said actuation member, and an extension at the second end of each indication lever interposed between the engagement surface on said static member and the engagement surface on said actuation member, at least one of said engagement surfaces being inclined so that the extension of said indication lever is frictionally gripped between said surfaces upon non-pivotal relative movement to prevent further relative movement between said actuation member and said gas turbine engine casing and thereby provide said indication of non-simultaneous, non-pivotal vane movement.

7. The aerofoil vane actuation member as claimed in claim 6, wherein said extension at the second end of said indication lever is wedge-shaped and is disposed between said engagement surface on said actuation member, and said engagement surface on said static member, at least one of said engagement surfaces being inclined so that said wedge-shaped extension passes freely between said engagement surfaces upon pivotal relative movement but upon non-pivotal relative movement said wedge shaped extension is frictionally gripped between said engagement surfaces to prevent further relative movement between said actuation member and said gas turbine.

* * * * *